US005938145A

United States Patent [19]

Dueck

[11] Patent Number: 5,938,145

[45] Date of Patent: Aug. 17, 1999

[54] WIRE CAROUSEL

[76] Inventor: Raymond Dueck, P.O. Box 700, Arborg, Canada

[21] Appl. No.: 08/825,902

[22] Filed: Apr. 2, 1997

[51] Int. Cl.[6] ..... B65H 19/00

[52] U.S. Cl. ..... 242/559.4; 242/559.1; 242/594.4; 242/598.4; 211/1.56; 211/85.5

[58] Field of Search ..... 242/559.4, 559.1, 242/559.3, 594.4, 594.6, 598.4, 129.6, 129.62; 211/1.53, 1.55, 1.56, 85.5

[56] References Cited

U.S. PATENT DOCUMENTS

| | | | |
|---|---|---|---|
| 511,104 | 12/1893 | Tower . | |
| 602,344 | 4/1898 | Martin . | |
| 649,038 | 5/1900 | Barnett . | |
| 849,589 | 4/1907 | Arnold . | |
| 980,534 | 7/1911 | Kerr . | |
| 1,009,827 | 11/1911 | Capers . | |
| 2,242,810 | 5/1941 | Bostwick . | |
| 2,281,137 | 4/1942 | Borevitz . | |
| 2,829,780 | 4/1958 | Boor | 211/1.56 X |
| 3,822,044 | 7/1974 | Riekinnen . | |
| 4,650,264 | 3/1987 | Dahnert | 211/1.56 X |
| 4,819,887 | 4/1989 | Dueck . | |
| 4,821,887 | 4/1989 | Iemura et al. | 211/1.56 |
| 5,029,766 | 7/1991 | Emming . | |

FOREIGN PATENT DOCUMENTS

| | | | |
|---|---|---|---|
| 357493 | 3/1990 | European Pat. Off. | 211/85.5 |
| 1121834 | 8/1956 | France | 211/1.56 |

*Primary Examiner*—Donald P. Walsh
*Assistant Examiner*—William A. Rivera
*Attorney, Agent, or Firm*—Adrian D. Battison; Murray E. Thrift

[57] ABSTRACT

A powered carousel for storing spools of wire. The wire carousel comprises an upright support frame having a carousel on the support frame mounting a plurality of carrier frames, each carrier frame has a plurality of removable shafts for mounting spools of wire. Each removable shaft is positively secured by a locking mechanism which positively engages each end of the shaft. This helps prevent a shaft from accidentally coming free from the frame and falling from the carousel possibly causing injury to the individual operating the carousel or to bystanders. To provide for the efficient storage of small spools of wire a removable Ferris wheel is mounted on one or more of the shafts. The Ferris wheel includes a plurality of rods for mounting spools of wire arranged annularly therearound and is mounted for rotation on the shaft. The carrier frames have been improved to further improve access to the spools of wire and to improve the stability of the carrier frames. To do this the connection means for mounting the carrier on the carousel has been positioned below the top of the carrier frame. A bottom member has also been added to each carrier frame to prevent wire from hanging down from the frame and getting snagged on a lower frame, on a shaft on a lower frame, or in the drive chain.

9 Claims, 11 Drawing Sheets

59
61
67
65
69
98
96
100
112
104
88
108
102
106
90
110
76
84
86
60
78
80
74
82

69
60
74
65
104
67

65
86
124
79
80
78
74
66
84
82

122
125
114
126
66
116
124
68
118
70
120
128

WIRE CAROUSEL

FIELD OF THE INVENTION

The present invention relates to a storage carousel for storing spools of elongate material.

BACKGROUND

Storage devices for storing spools of wire and other elongate materials such as cable, chain, rope, and tubing, to name but a few, are well known. These devices are often wall or floor mounted racks which mount the spools at fixed heights. Racks of this type are often inefficient since they do not make good use of much of the space available for storage. This is due in part to the need for these racks to be of limited height so that an individual may reach the spools being stored. Some racks of this type make better use of the vertical space available by extending vertically to the roof but usually require the use of elevating devices to enable an individual to retrieve a spool.

Large vertical carousels for storing wire are known for use in some industrial and commercial applications. One such carousel employs a number of frames mounted on the carousel. Each frame has a number of shafts for supporting spools. The frames are arranged for movement around a continuous loop on the carousel. This allows a user to selectively position a spool within view and within easy reach, and enables an individual to access all of the spools without the use of a ladder or other elevating device. A carousel of this type is more efficient than a fixed rack and provides for the storage of a large number of spools for a given square footage of floor space. These devices generally mount the frames on a driven cable or chain arranged at either end of the frame. The driven chain drives the frame in a continuous loop around the carousel. An actuating means is usually provided which allows a user to move the frames and spools around the carousel until a desired spool comes within reach or view.

One problem associated with this type of carousel is that the shafts for mounting the spools of wire are usually not locked or otherwise positively secured on the frames. This can lead to the shafts accidentally coming free from the frame and falling from the carousel possibly causing injury to the individual operating the carousel or to bystanders.

A second problem is that a limited number of spools can be mounted along the length of each shaft. This can reduce the efficiency of the carousel when small spools of wire are stored since the small spools take up the available space along the shafts but do not make good use of all of the space around the shafts.

A third problem is that the structure of existing frames allow wires to hang down from the frame which can lead to the wires getting snagged on a lower frame, on a shaft on a lower frame, or in the drive chain, all of which can also lead to shafts being pulled off of the frame.

SUMMARY

According to the present invention there is provided a wire carousel for storing spools of wire said wire carousel comprising:

a support frame having a first upright frame end and a second upright frame end, said second upright frame end being spaced apart from the first upright frame end;

at least one carrier frame comprising a top frame member, a bottom frame member, a first end arranged adjacent the first upright frame end of the support frame, and a second end arranged adjacent the second upright frame end of the support frame, and a plurality of upright members being spaced apart from one another and extending between the top and bottom frame members and being fixed thereto;

a plurality of shaft members for mounting at least one spool of wire thereon, each shaft member having a first end and a second end and being arranged to extend between an adjacent pair of the plurality of upright members such that the first end of each respective shaft member is arranged to lie adjacent one of the pair of upright members and such that the second end of each respective shaft member is arranged to lie adjacent the other one of the pair of upright members;

removable and reengageable connection means for connecting each respective end of each one of the plurality of shaft members to an adjacent one of the upright members and for positively engaging each end of each one of the plurality of shaft members locking it in place on said adjacent upright member;

drive means mounted on at least one of the support frame ends and being connected to the at least one carrier frame for providing movement of the at least one carrier frame in a continuous loop on said support frame ends;

and actuating means for selectively actuating the drive means.

The shafts for mounting the spools of wire are positively secured on the frames carrying the spools in such a manner that the shafts can easily be removed and replaced on the frame.

According to a second aspect of the invention there is provided a wire carousel for storing spools of wire said wire carousel comprising:

a support frame having a first upright frame end and a second upright frame end, said second upright frame end being spaced apart from the first upright frame end;

at least one carrier frame having a top, a bottom, a first end arranged adjacent the first upright frame end of the support frame, and a second end arranged adjacent the second upright frame end of the support frame;

at least one shaft member mounted on the carrier frame for mounting at least one spool of wire thereon;

a pair of mounting members fixed to each at least one carrier frame for removably and reengageably engaging the drive means, said mounting members being arranged such that one mounting member is fixed to each of the first and second ends of said carrier frame at locations spaced a distance downwards from the top of the carrier frame;

drive means mounted on at least one of the support frame ends for providing movement of the at least one carrier frame in a continuous loop on said support frame ends, said drive means including a plurality of connection members each arranged to cooperate with a corresponding mounting member on one of the carrier frames thereby connecting said carrier frames to the drive means;

and actuating means for selectively actuating the drive means.

According to a third aspect of the invention there is provided a wire carousel for storing spools of wire said wire carousel comprising:

a support frame having a first upright frame end and a second upright frame end, said second upright frame end being spaced apart from the first upright frame end;

at least one carrier frame having a top, a bottom, a first end arranged adjacent the first upright frame end of the support frame, and a second end arranged adjacent the second upright frame end of the support frame;

at least one shaft member mounted on the carrier frame;

at least one rotatable Ferris wheel mounted on the at least one shaft member, said at least one rotatable Ferris wheel including a plurality of rods being spaced apart and arranged annularly therearound, each one of said rods being arranged to mount at least one spool of wire thereon;

drive means mounted on at least one of the support frame ends and for providing movement of the at least one carrier frame in a continuous loop on said support frame ends;

and actuating means for selectively actuating the drive means.

BRIEF DESCRIPTION OF THE DRAWINGS

In the accompanying drawings, which illustrate an exemplary embodiment of the present invention.

DETAILED DESCRIPTION

Figure 1:
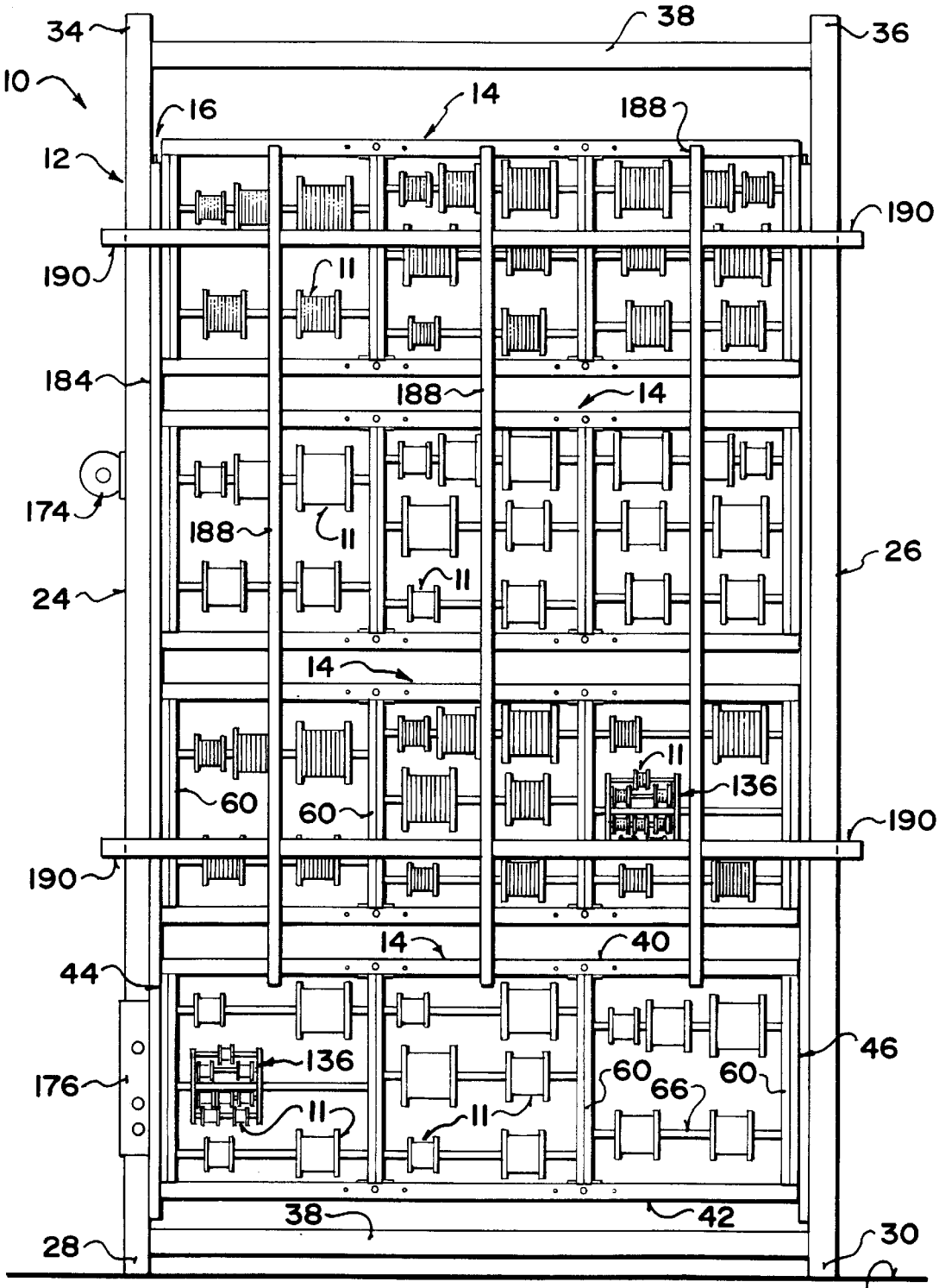
FIG. 1 is a front view of the wire carousel.
Figure 2:
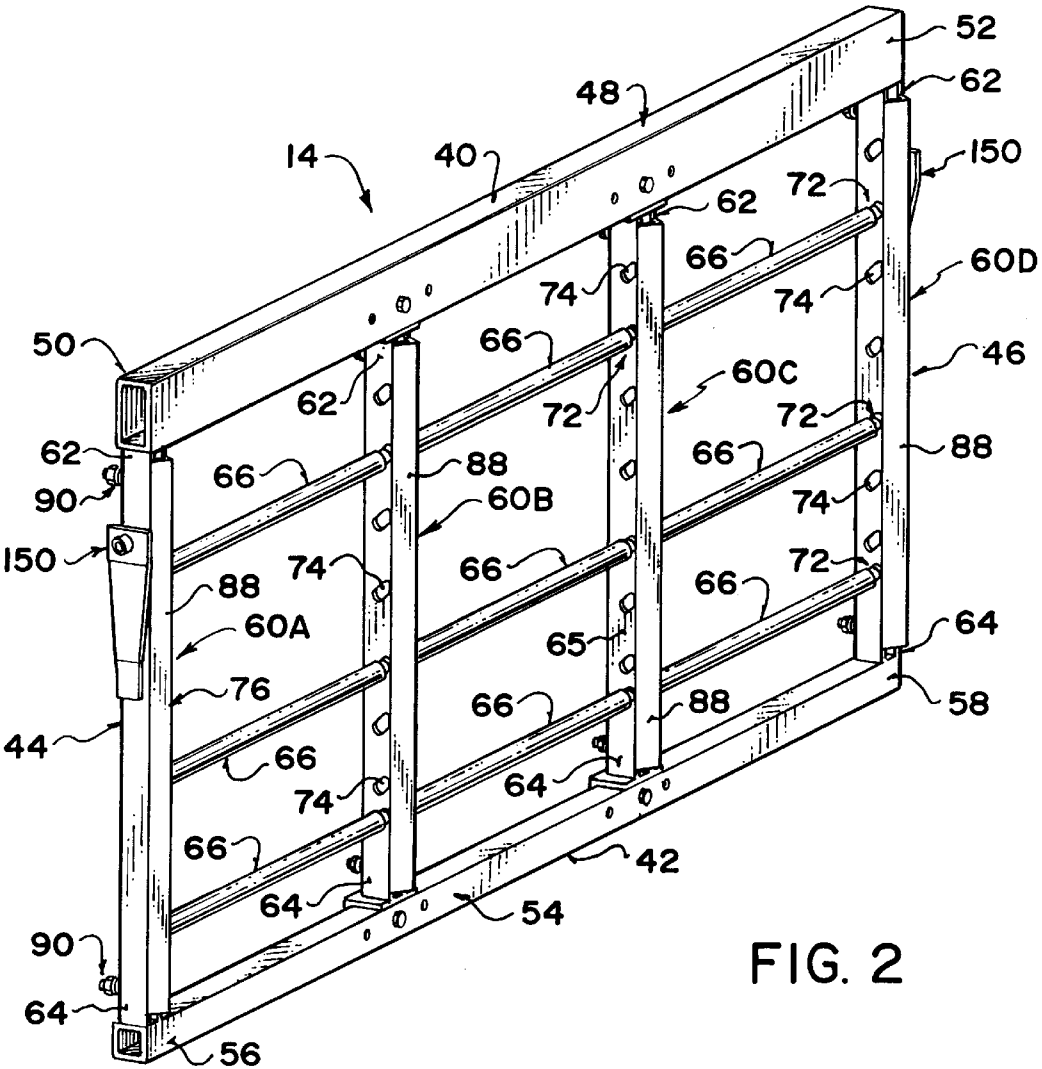
FIG. 2 is a perspective view of a carrier frame.
Figure 3:
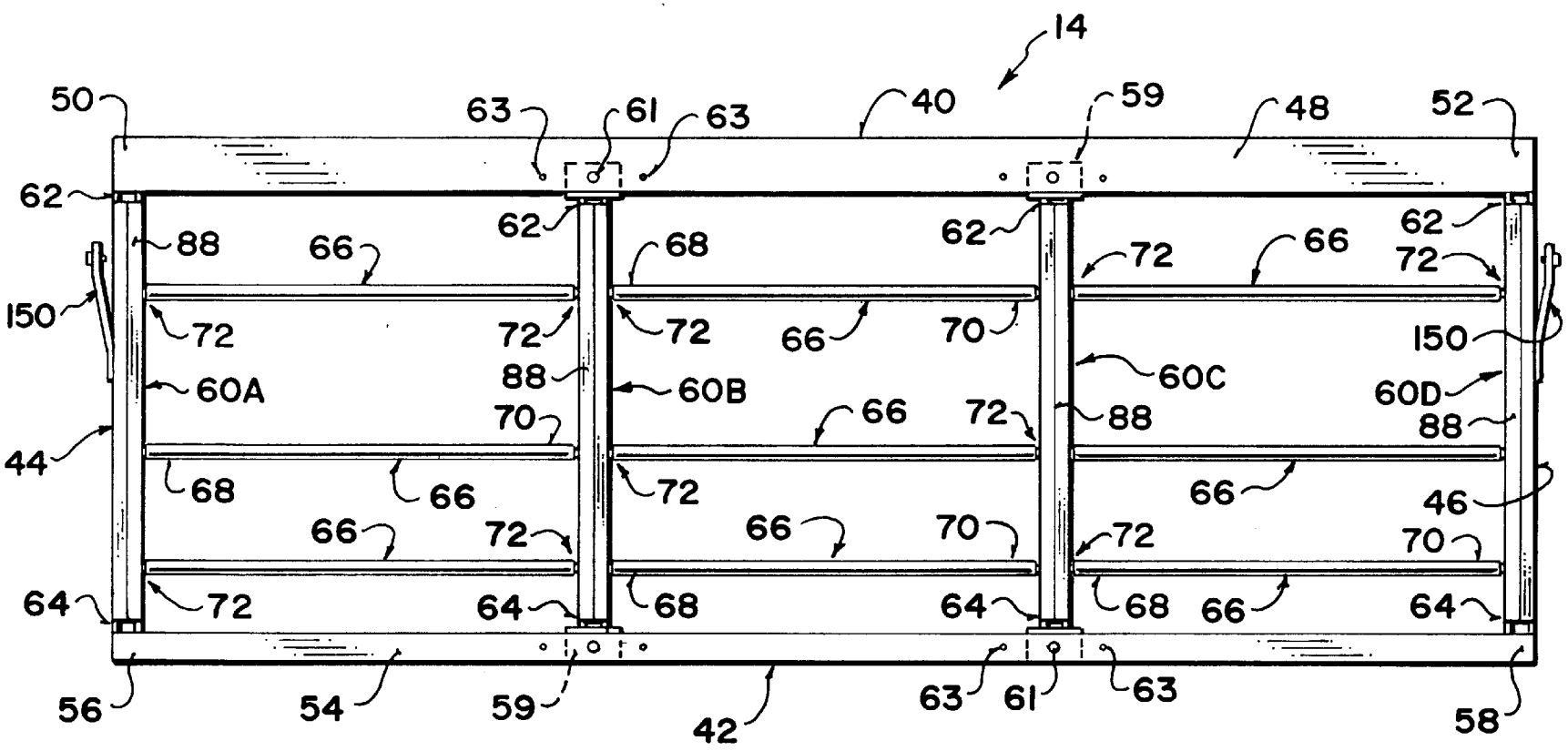
FIG. 3 is a front view of a carrier frame.
Figure 4:
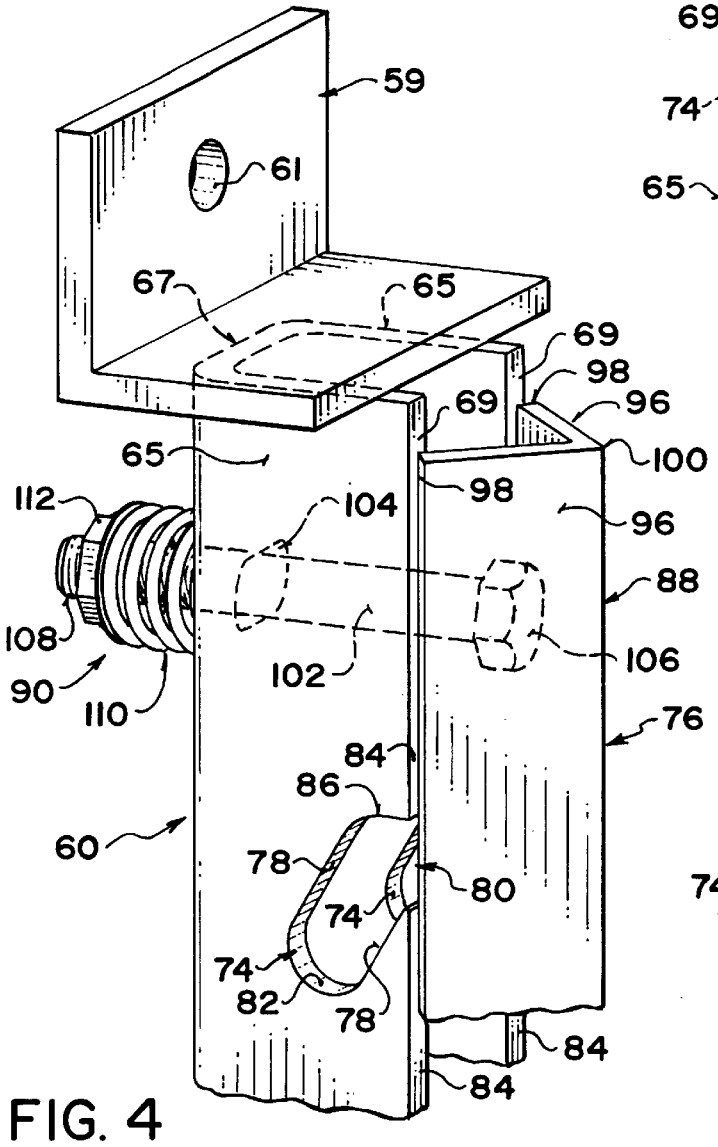
FIG. 4 is a perspective view of one end of one of the upright members.
Figure 5:
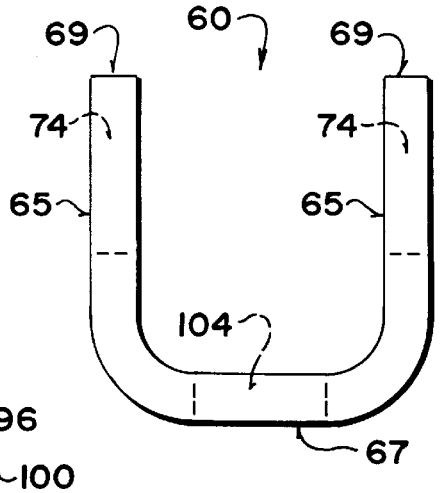
FIG. 5 is a top view of the U-shaped portion of one of the upright members.
Figure 6:
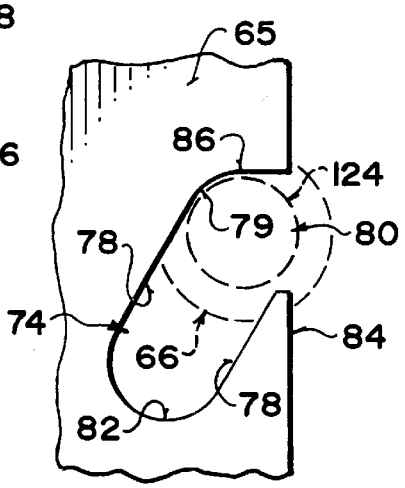
FIG. 6 is a partial view of one of the arms of one of the upright members showing the slot.
Figure 7:
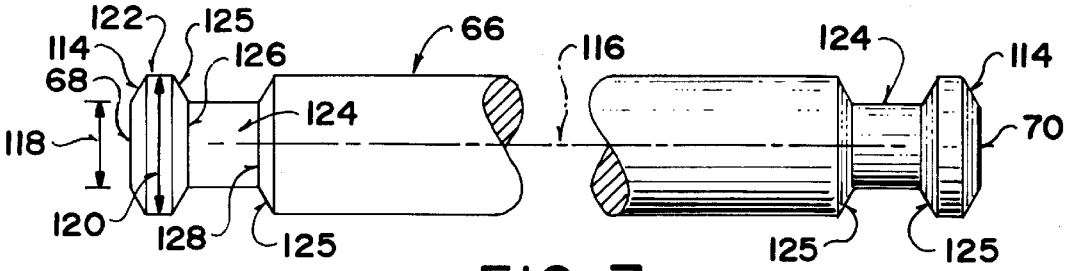
FIG. 7 is a front view of one of the shafts for mounting the spools.
Figure 8:
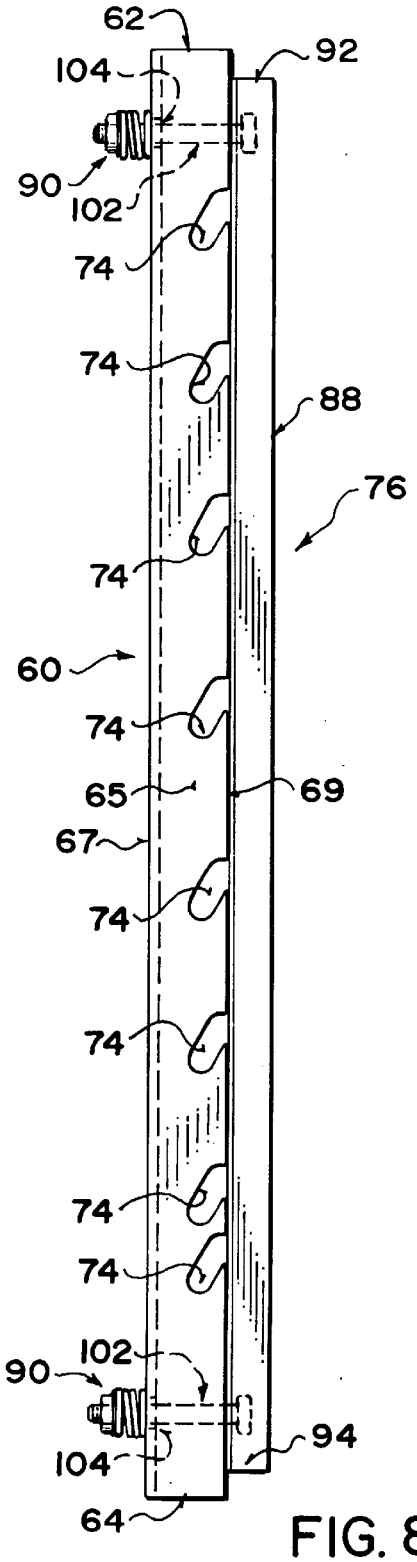
FIG. 8 is a side view of the upright member arranged at the second end of the carrier frame.
Figure 9:
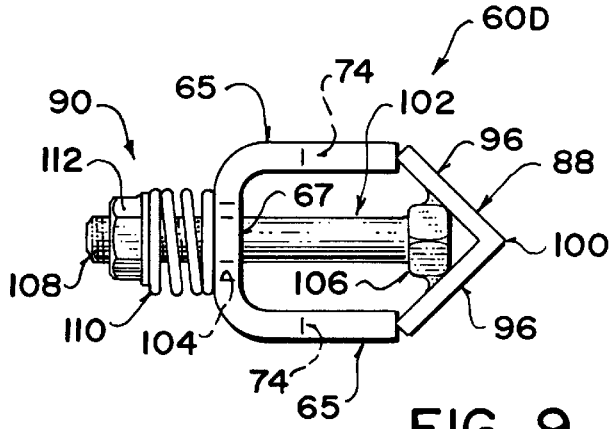
FIG. 9 is a top view of the upright member arranged at the second end of the carrier frame.
Figure 10:
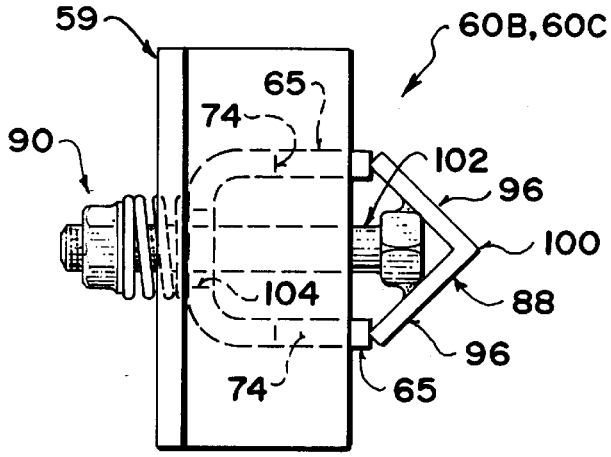
FIG. 10 is a top view of one of the upright members arranged between the ends of the carrier frame.
Figure 11:
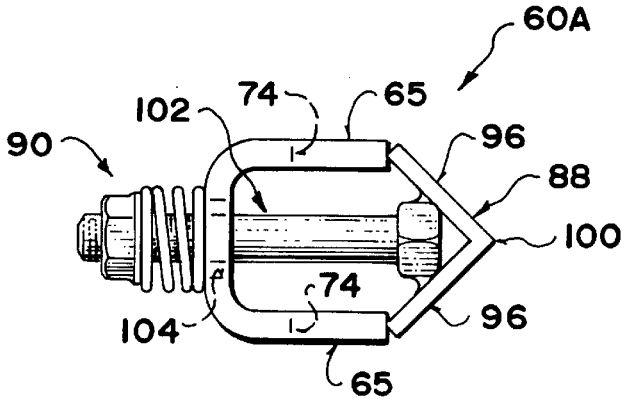
FIG. 11 is a top view of the upright members arranged at the first end of the carrier frame.

Referring to FIGS. 1 to 3 the wire carousel is shown generally at 10. The wire carousel 10 is for use in storing various sized spools 11 of elongate material such as wire. The wire carousel 10 comprises an upright support frame 12, a plurality of carrier frames 14 arranged for movement on the support frame 12 and for carrying the spools of wire 11, and drive means 16 (FIGS. 22 and 23) arranged on the upright support frame 12 providing for movement of the carrier frames 14 in a continuos loop on the carousel 10.

The upright support frame 12 comprises first and second upright frame ends 24 and 26. The first and second upright frame ends 24 and 26 are spaced apart from one another and are arranged such that their respective bottom ends 28 and 30 lie in contact with a supporting surface 32. Each upright 24 and 26 extends upwards from its respective bottom end 28 and 30 to respective top ends 34 and 36. One or more longitudinal support members 38 extend between the upright first and second end frames 24 and 26 holding them in the upright position.

The carrier frames 14 are arranged between the first and second upright frame ends 24 and 26. Each carrier frame 14 includes a top 40, a bottom 42, a first end 44 arranged adjacent the first upright frame end 24 of the support frame 12, and a second end 46 arranged adjacent the second upright frame end 26 of the support frame 12.

The top 40 of the carrier frame 14 is provided by a top frame member 48 which extends from a first end 50 arranged adjacent the first upright frame end 24 to a second end 52 arranged adjacent the second upright frame end 26. The bottom 42 of the carrier frame 14 is provided by a bottom frame member 54 which extends from a first end 56 arranged adjacent the first upright frame end 24 to a second end 58 arranged adjacent the second upright frame end 26.

Four upright members 60 each having a top end 62 and a bottom end 64 extend between the top and bottom carrier frame members 48 and 54. Each upright 60 is fixed at its top end 62 to the top member 48 and at its bottom end 64 to the bottom member 54. One upright member 60A is arranged at the first end 44 of the carrier frame 14 and another upright member 60D is arranged at the second end 46 of the carrier frame 14. The remaining upright members 60B and 60C lie between the ends 44 and 46 and are spaced apart from each other and from the upright members 60A and 60D.

Figure 13:
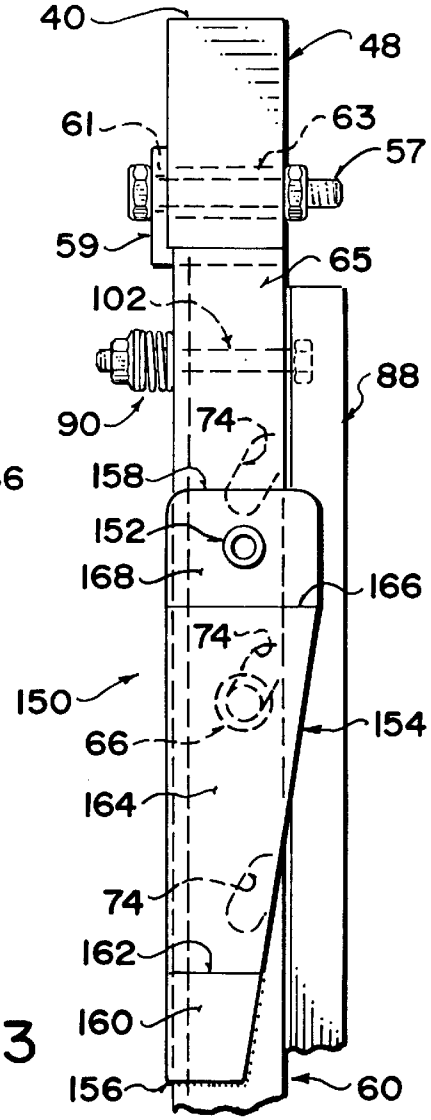
FIG. 13 is a partial side view of the carrier frame showing the mounting member.
Figure 14:
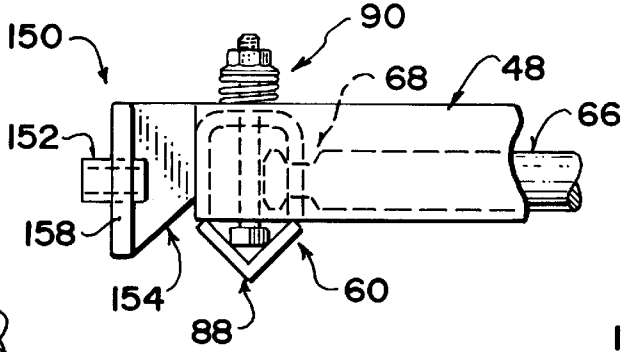
FIG. 14 is a partial top view of the carrier frame showing the mounting member.
Figure 12:
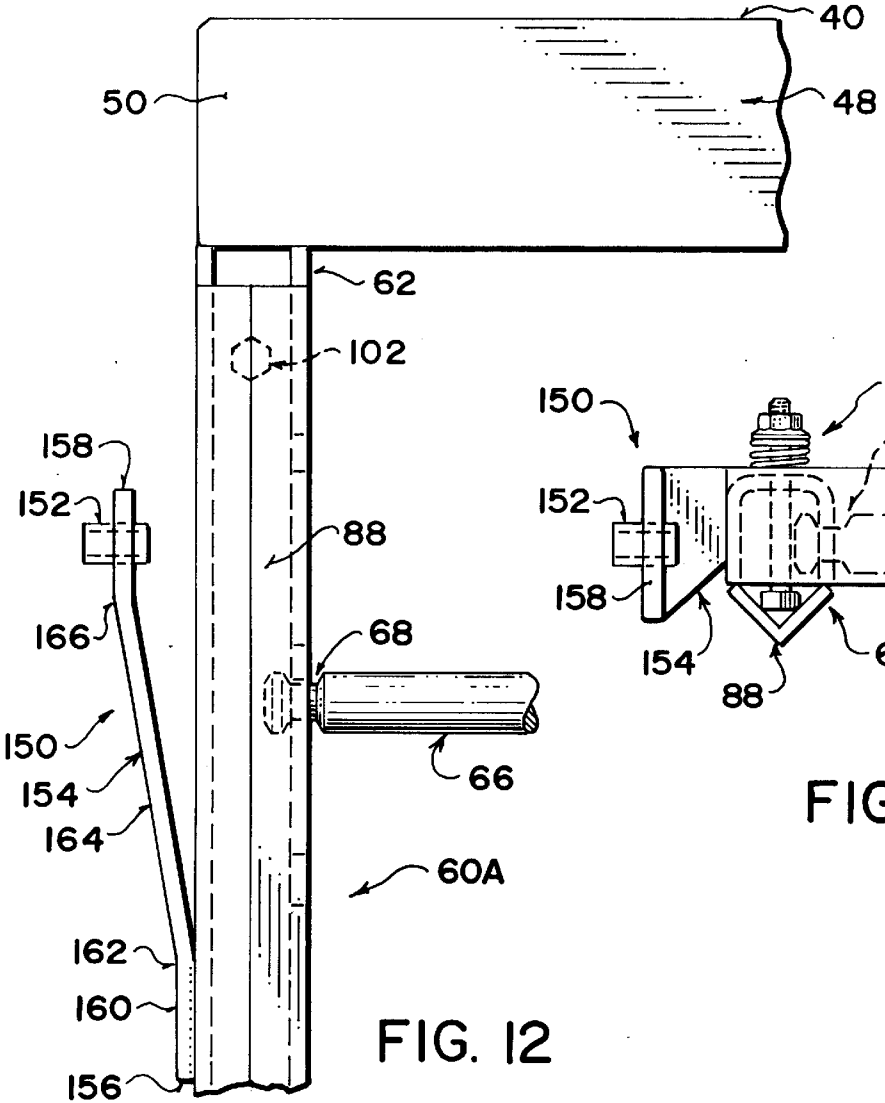
FIG. 12 is a partial front view of the carrier frame showing the mounting member.
Figure 15:
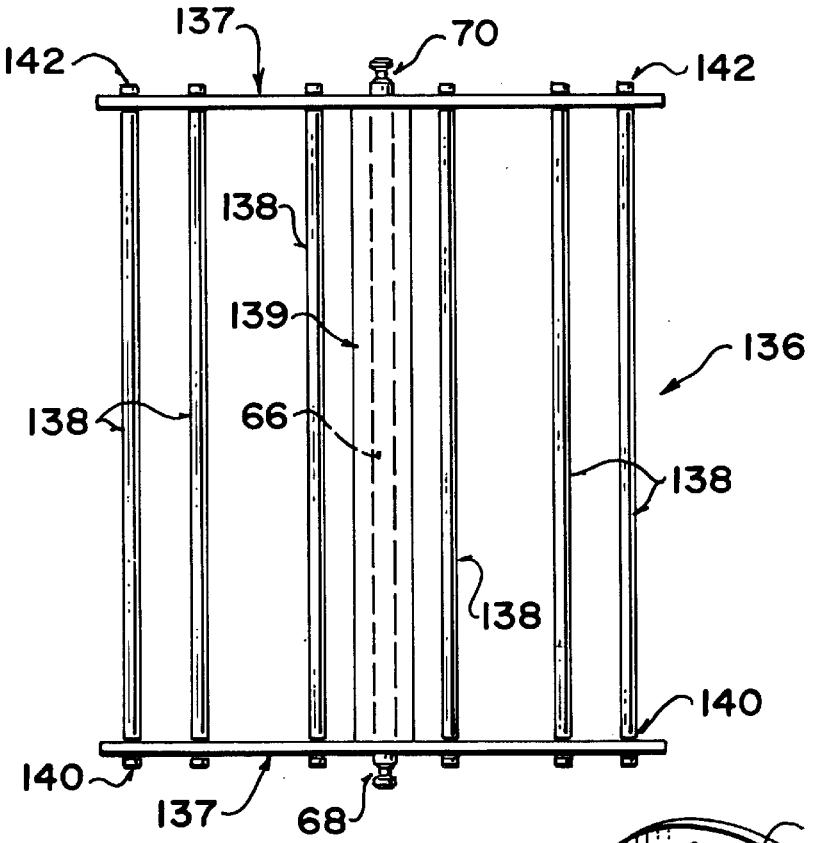
FIG. 15 is a top view of the Ferris wheel.
Figure 16:
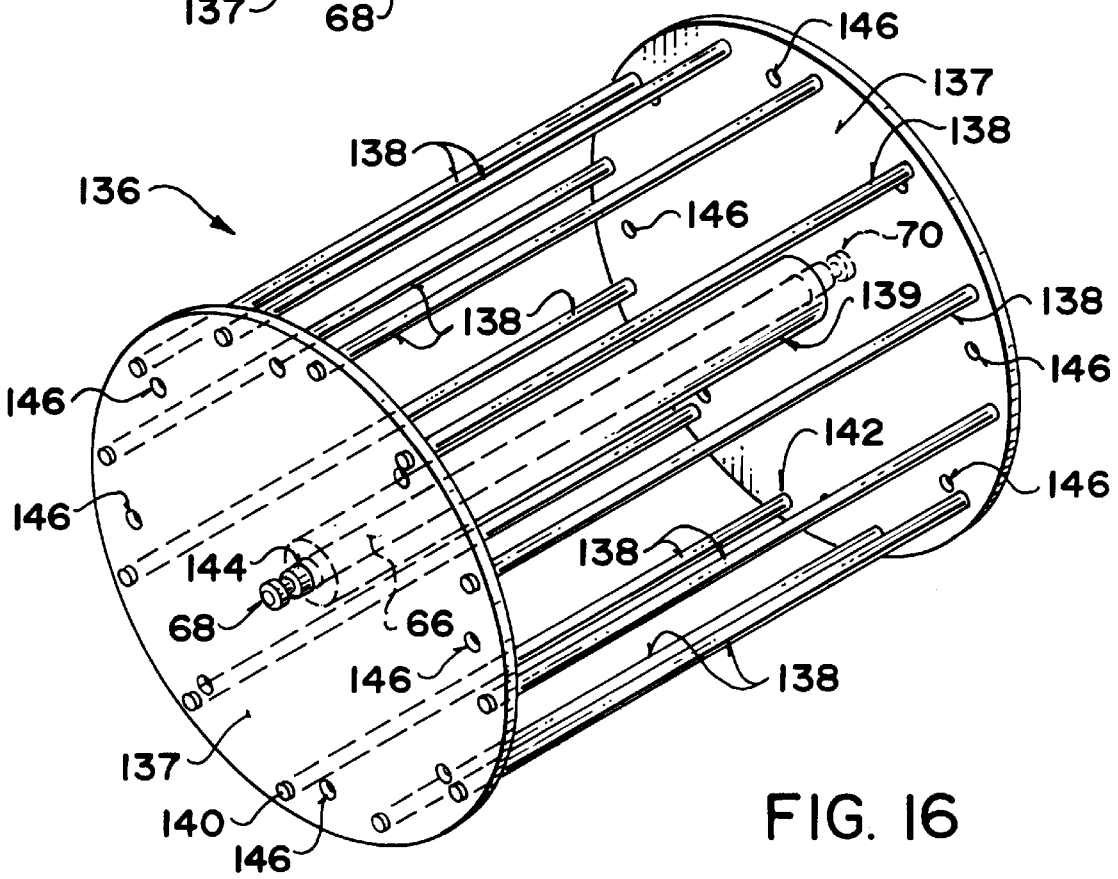
FIG. 16 is a perspective view of the Ferris wheel.
Figure 17:
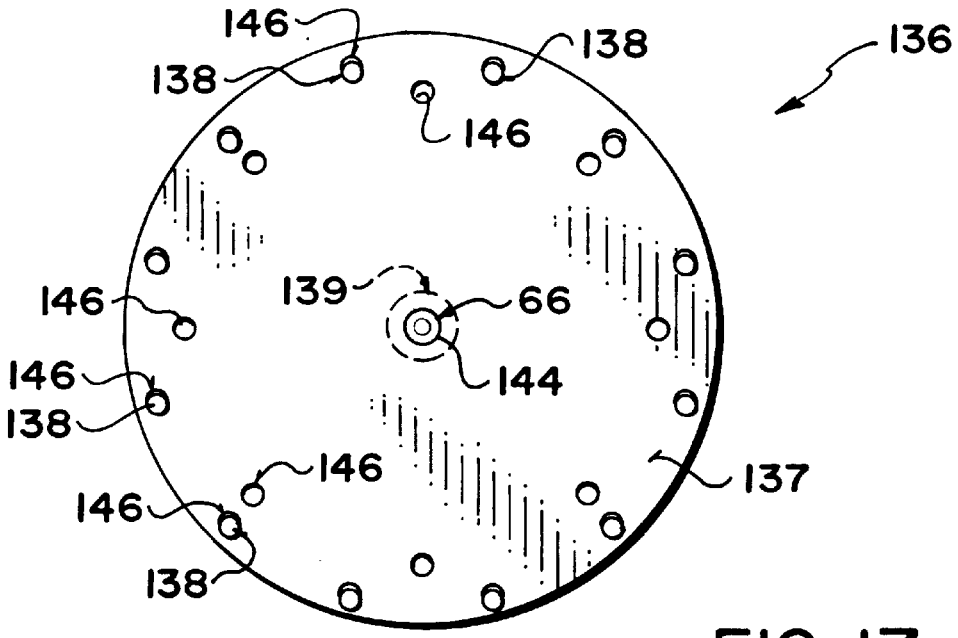
FIG. 17 is a side view of the Ferris wheel.
Figure 18:
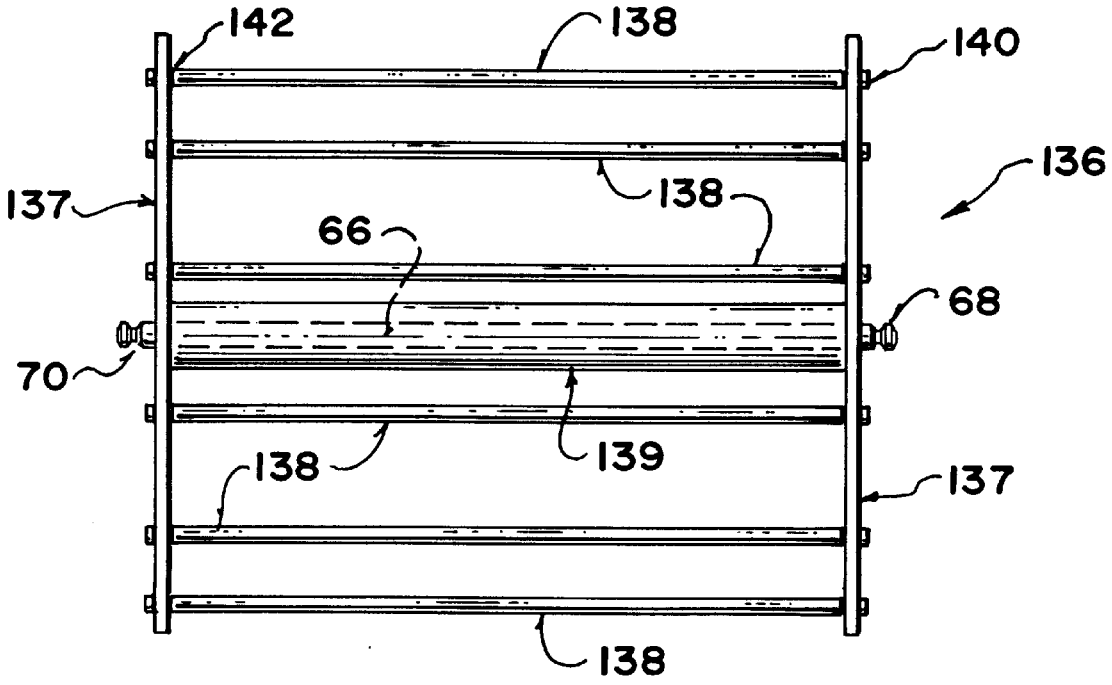
FIG. 18 is a front view of the Ferris wheel.

Referring to FIGS. 2, 3, and 13 the upright members 60B and 60C are each fixed to the top and bottom members 48 and 54 of the carrier frame 14 by an L-shaped member 59 arranged at each end of the member 60B or 60C. The L-shaped member 59 is arranged such that the foot of the L is fixed to the top or bottom end 62 or 64 of the upright member 60B or 60C and extends across a face of the top and bottom members 48 and 54 lying adjacent the end of the upright member. The leg of the L lies along a rear face of the top or bottom members 48 and 54 and includes a hole 61 arranged therethrough for aligning with one of a plurality of holes 63 through the top or bottom member 48 or 54. A removable and engageable fastener 57 is arranged to extend through the aligned holes 61 and 63 fixing the upright member 60B or 60C to the top or bottom member 48 or 54.

Referring to FIGS. 2 to 7 each upright member 60 comprises a U-shaped elongate channel member arranged such that the arms 65 of the U project in a direction perpendicular to the plane of the carrier frame 14 and towards the front of the wire carousel 10. The base 67 of the U faces a rear of the wire carousel 10.

A plurality of shaft members 66 are removably mounted on each of the carrier frames 14. Each shaft member 66 extends horizontally between an adjacent pair of the upright members 60 and is arranged to support at least one spool of wire 11. Each shaft member 66 has a first end 68 and a second end 70 and is arranged such that the first end 68 lies adjacent one of the pair of upright members 60 and such that the second end 70 lies adjacent the other one of the pair of upright members 60. Each shaft 66 is selected to have an outer diameter sized to engage through an opening at the center of a spool 11.

A removable and reengageable connection means 72 is provided for connecting each end 68 and 70 of each shaft member 66 to an adjacent upright member 60. The connection means 72 positively engage the respective ends 68 or 70 of the shaft member 66 locking the shaft 66 in place on the upright member 60.

Referring to FIGS. 2 to 11 the removable and reengageable connection means 72 comprise a plurality of slots 74 arranged on each of the upright members 60 for accepting an end of one of the shaft members 66, and a locking mechanism 76 for holding the shafts 66 in place in the slots 74.

The plurality of slots 74 are spaced apart vertically along each one of the upright members 60. The slots 74 on each upright member 60 are arranged such that they align with corresponding slots 74 on upright members 60 lying adjacent. Each slot 74 has sides 78, a mouth 80, and an end 82, shown best in FIG. 8. The sides 78 are spaced a distance apart from one another (½") and extend from the mouth 80 to the end 82. The mouth 80 is located at an edge 84 defined by the end of one of the arms 65 of the U of the upright member 60. The end 82 of the slot 74 is arranged below the mouth 80 and inwards from the edge 84 such that each slot 74 slopes downwards at an angle towards the bottom of the carrier frame 14. The downwards slope of the slot 74 helps secure the end of the shaft 66 in place in the slot 74.

At the mouth 80 of each slot 74 the sides 78 extend a distance into the edge 84 of the U-shaped member 60 such that the sides 78 are substantially perpendicular to the edge 84 and lie in a substantially horizontal plane. The sides 78 thus extend from the edge 84 substantially horizontally to a first point 86, then angle downwards to the end 82 of the slot 74. At the first point 86 is a radius 79 arranged along an upper side 78 of the slot 74 arranged to receive an end 68 or 70 of a shaft 66 such that the end 68 or 70 may be positioned into the slot mouth 80 from beside the upright member 60. The end 82 of the slot 74 is curved to better accommodate the shaft 66.

The slots 74 on the upright member 60A are arranged along the arm 65 of the U of the upright member 60A which lies closest to the upright member 60B. Likewise the slots 74 on the upright member 60D are arranged along the arm 65 of the U of the upright member 60D which lies closest to the upright member 60C. The slots 74 on the remaining upright members 60B and 60C are arranged along each of the arms 65 of the upright members 60B and 60C.

Referring to FIGS. 4, 8 to 14, and 21, the locking mechanism 76 comprises a locking member 88 and biasing means 90 arranged on each of the upright members 60. The locking member 88 is arranged to lie parallel to and extends along at least a portion of the length of the upright member 60 and is arranged to extend across the mouth 80 of each of the slots 74. The biasing means 90 connect the locking member 88 to the upright member 60 and bias the locking member 88 towards a position longitudinally aligned with the upright member 60 thereby centering the locking member 88 on the upright members 60.

Each locking member 88 comprises an elongate V-shaped channel member having a first end 92 and a second end 94. The V of the channel comprises a pair of arms 96 each extending from an end 98 to a vertex 100. The arms 96 are joined together a the vertex 100. Each locking member 88 is arranged to lie parallel to a corresponding upright member 60 and along a portion of the length of the upright member 60 such that the ends 98 of the arms 96 of the V-shaped channel lie adjacent and aligned with the ends 69 of the arms 65 of the U of the upright member 60. The ends 98 of the arms 96 of the V channel thus extend across the mouth 80 of each of the slots 74 closing the mouth 80.

The biasing means 90 comprise a pair of elongate members 102 arranged one at each end of the locking member 88. Each elongate member 102 is fixed to the locking member 88 and is connected to the upright member 60. Each elongate member 102 is arranged to lie between the arms 65 of the U of the upright member 60 and between the arms 96 of the V shaped member. A hole 104 is arranged adjacent each of the ends 62 and 64 of each upright member 60, and extends through the base 67 of the U of the upright member 60. Each hole 104 is oblong in shape extending laterally across the U-shaped member and is arranged to accept one of the elongate members 102 of the biasing means 90.

Each elongate member 102 has a first end 106 and a threaded second end 108. The first end 106 is fixed at the vertex 100 of the V of the locking member 88, and the second end 108 extends through the hole 104 in the base 67 of the U of the upright member 60 to a position to the rear of the base 67. A resilient means, usually a coil spring 110, is arranged at the second end 108 of each elongate member 102 such that it engages the rear side of the base 67 of the U of the upright member 60. The coil spring 110 is arranged around the second end 108 of the elongate member 102 and is fastened in place by a nut 112.

When the end of one of the shafts 66 is forced into one of the slots 74 the locking member 88 is moved laterally. This causes the locking member 88 to move away from the position aligned with the upright member 60 such that the ends 98 of the arms 96 of the V-shaped member move away from the ends 69 of the arms 65 of the U-shaped member allowing the shaft 66 to enter a slot 74 As a result the elongate member 102 is moved in the hole 104 towards one side of the hole 104. This compresses the coil spring 110 to one side which applies a force to the elongate member 102 biasing the elongate member 102 back towards the centre of the hole 104. This causes the locking member 88 to move in a direction back towards the position where it is aligned with the upright member 60.

Referring to FIGS. 7, and 12 to 14 a first taper 114 is arranged at each of the first and second ends 68 and 70 of each one of the shaft members 66. Each taper 114 angles back along the shaft 66 from a respective end 68 or 70 and upwards and outwards in a direction away from a longitudinal centre line 116 of the shaft 66. The taper 114 slopes from a first diameter 118 (15/32") at the respective end 68 or 70 to a second diameter 120 (¾") at a location 122 spaced from the end 68 or 70 of the shaft member 66. The first diameter 118 is smaller than the distance (½") defining the space between the sides 78 of each of the plurality of slots 74, and the second diameter 120 is larger than the distance defining the space between the sides 78 of each of the plurality of slots 74.

An annular recess 124 is arranged around each of the plurality of shaft members 66 adjacent each of the first and second ends 68 and 70 of the shaft 66. The annular recess 124 is spaced inwards from the respective end 68 or 70 of the shaft member 66 and is spaced a distance (¼") along the shaft from the first taper 114. The diameter of the shaft (¾") is larger than the distance between the sides 78 of each slot 74 at locations 125 and 127 adjacent the annular recess 124, thereby forming shoulders 125, and the diameter of the annular recess 124 (15/32") is smaller than the distance between the sides 78 of each of the plurality of slots 74 (½").

This allows the shaft 66 to be positioned within the slot 74 and yet be held in place laterally within the slot 74 by the shoulders 125.

Each annular recess 124 includes a first end 126 spaced a first distance (¼") from a respective end 68 or 70 of the shaft member 66, and a second end 128 spaced a second distance (⅜") from the first end 126 of the annular recess 124. The length (⅜") of the annular recess 124 along the shaft 66 is greater than the distance from the end of the shaft 68 or 70 to the first end 126 of the annular recess 124 (¼"). The arms 65 of the U of the upright member 60 are spaced apart a distance greater than or equal to the length of the annular recess 124. This permits some play in the locking mechanism 76 which allows a free end of the shaft member 66 to be repositioned laterally for engagement within an adjacent slot 74 when the other end of the shaft 66 is locked in place in a slot 74 opposite.

To lock an end of one of the shafts 66 in place in a slot 74 the end 68 or 70 is positioned at the mouth 80 of the slot 74. The taper 114 at the end 68 or 70 of one of the shafts 66 is forced onto the mouth 80 of a slot 74 causing the locking member 88 to be moved laterally away from the upright member 60 and mouth 80 of the slot 74 allowing the end 68 or 70 of the shaft 60 to enter between that the arms 65 of the U of the upright member 60. The end 68 or 70 of the shaft 66 is forced into the mouth 80 until the annular recess 124 lies between the sides 78 of the slot 74. With the sides 78 of the slot 74 lying in the annular recess 124 the shaft 66 is moved downwards along the slot 74 to the end 82 of the slot 74. As this occurs the locking member 88 is biased back towards the upright member 60 closing the mouth 80 of the slot 74 and holding the shaft 66 in place within the slot 74.

Figure 19:
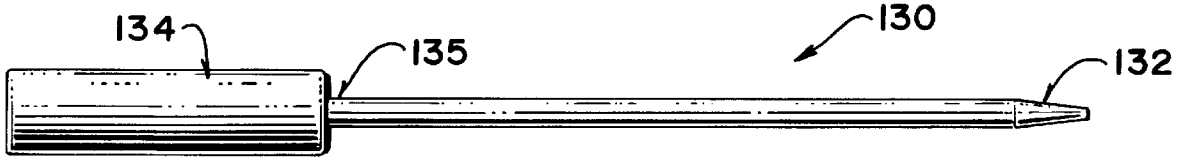
FIG. 19 is a side view of the unlocking lever.
Figure 20:
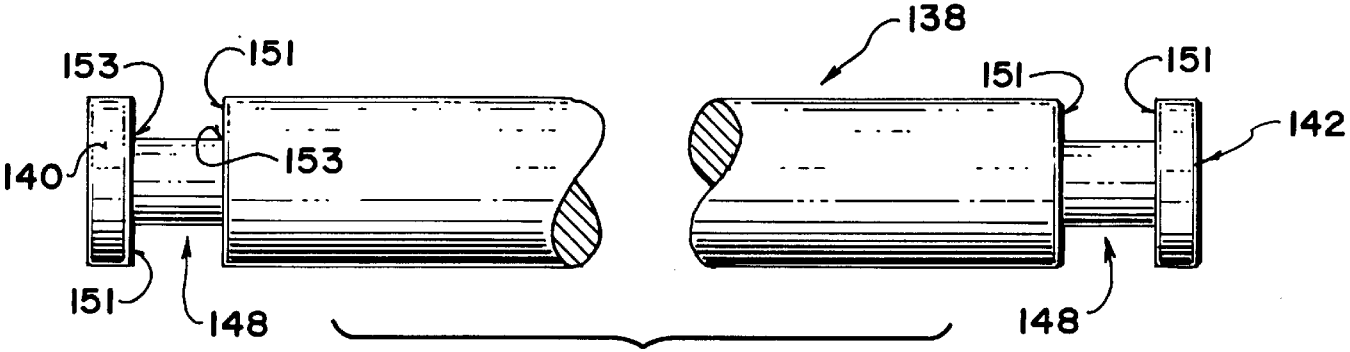
FIG. 20 is a side view of one of the rods.

Referring to FIG. 19 an unlocking lever 130 is provided for unlocking the locking mechanism 76 to allow the shaft 66 to be removed from the carrier frame 14. The unlocking lever 130 comprises an elongate member having a tapered first end 132 and a handle 134 at a second end 135. The tapered first end 132 is arranged to engage between the locking member 88 and the upright member 60 to force them apart so that the shaft 66 can be removed.

Referring to FIGS. 15 to 21 one or more rotatable Ferris wheels 136 are provided for mounting on one or more of the shaft members 66. The Ferris wheels 136 allow for the efficient storage of small spools of wire 11. Each rotatable Ferris wheel 136 comprises a pair of spaced apart plate members 137. The plate members 137 are connected to one another by an elongate tubular member 139 extending between centers of the plate members 137. A respective one of the shaft members 66 extends through an opening 144 aligned with the tubular member 139 at the center of each plate member 137 thereby removably mounting the Ferris wheel 136 on the shaft 66 for rotation on the shaft member 66.

A plurality of rods 138 extend between the plate members 137. The rods 138 are arranged annularly around the plate members 137 and are spaced annularly apart from each other. Each one of the rods 138 extends between the plate members 137 from a first end 140 to a second end 142, and is sized and arranged to mount at least one spool of wire 11.

Removable and reengageable connection means connect the rods 138 between the plate members 137. The connection means are arranged to connect the ends 140 and 142 of the rods 138 at locations spaced annularly around each plate member 137 and at various distances from the center of the Ferris wheel 136. This allows for various sized spools 11 to be accommodated on the Ferris wheel 136.

The connection means comprise a plurality of openings 146 through each of the plate members 137 and an annular recess 148 arranged adjacent each end 140 and 142 of each rod 138. The openings 146 are arranged at locations spaced annularly apart from each other around the plate members 137 and at various distances from the center of the Ferris wheel 136. Each opening 146 is sized to be just large enough to receive an end 140 and 142 of the rod 138 therethrough.

Each rod 138 is an elongate member having a diameter slightly smaller than openings 146 and includes an annular recess 148 adjacent each of the first and second ends 140 and 142 of the rod 138. The annular recess 148 is spaced inwards a distance (⅛") along the rod 138 from the respective end 140 or 142. The annular recess 148 includes a first end 153 spaced a first distance (⅛") from a respective end 140 or 142 of the rod 138, and a second end 155 spaced a second distance (⅜") further along the rod 138 from the first end 153 of the annular recess 148. The diameter of the annular recess 148 (5/16") is smaller than the openings 146 and the diameter of the rod 138 at positions adjacent the first and second ends 153 and 155 of the annular recess 148 is larger (⅝") than the diameter of the annular recess 148 (5/16") thereby forming shoulders 151. The shoulders 151 hold the rod 138 in place laterally within the slot 146 when the rod 138 is positioned such that the shoulders 151 lie on each side of the plate member 137.

The length of the annular recess 148 (⅜") along the rod 138 is greater than the distance from an end of the rod 140 or 142 to the first end 153 of the annular recess 148 (⅛"). This permits some lateral play in the connection which allows an end 140 or 142 of the rod 138 not yet positioned in an adjacent opening 146 to be repositioned laterally for engagement within the adjacent opening 146 while the end of the rod 148 opposite is in place in a opening 146.

To connect an end 140 or 142 of one of the rods 138 in place in an opening 146 the end 140 or 142 is positioned through the opening until the plate member 137 lies between the shoulders 151 of the annular recess 148. The plate member 137 lies in the annular recess 124 such that the shoulders 151 of the annular recess lie one on each either side of the plate member 137 holding the rod 138 laterally in place within the opening 146. The end 140 or 142 of the rod 138 is held in place within the opening 146 since the opening 146 is only slightly larger than diameter of the rod 138, and since the weight of the rod 138 keeps the annular recess 148 in contact with the plate member 137 such that the shoulders 161 of the annular recess 148 lie on each side of the plate 137.

Referring to FIGS. 12 to 14, 22, and 23 the carrier frame 14 includes a pair of mounting members 150 for removably and reengageably connecting the carrier frame 14 on the drive means 16. The mounting members 150 are arranged such that one mounting member 150 is fixed to each of the first and second ends 44 and 46 of the carrier frame 14 at locations spaced a distance downwards from the top 40 of the carrier frame 14.

Each mounting member 150 comprises a tubular member 152 arranged to lie along an axis parallel and in line with the carrier frame 14, and a connecting member 154 arranged to connect the tubular member 152 to the carrier frame 14. The connecting member 154 is fixed at a first end 156 to a respective end 44 or 46 of the carrier frame 14 and is fixed to the tubular member 152 at a second end 158.

The connecting member 154 comprises an elongate member extending between the first end 156 and the second end 158. A first portion 160 of the elongate member 154 extends from the first end 156 to a first point 162 spaced from the first end 156, a second portion 164 of the connecting member 154 extends from the first point 162 at an angle to the first portion 160 and away from the carrier frame 14 to a second point 166. A third portion 168 of the connecting member 154 is arranged parallel to the first portion 160 and extends from the second point 166 to the second end 158 of the resilient member 154. The connecting member 154 is arranged such that the first end 156 is fixed to the respective end 44 or 46 of the carrier frame 14 and the second portion 164 angles away from the carrier frame 14.

Figure 21:
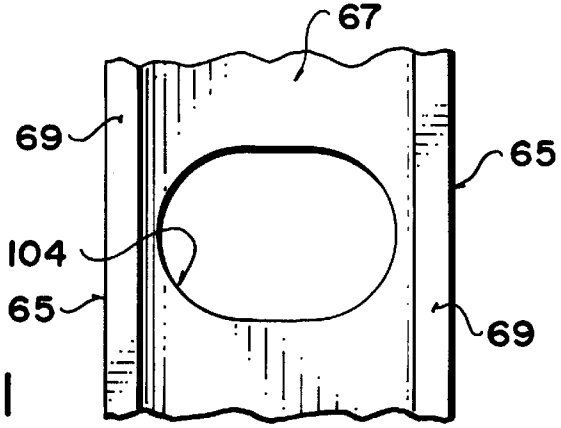
FIG. 21 is a partial side view of one of the U shaped members showing the opening.
Figure 22:
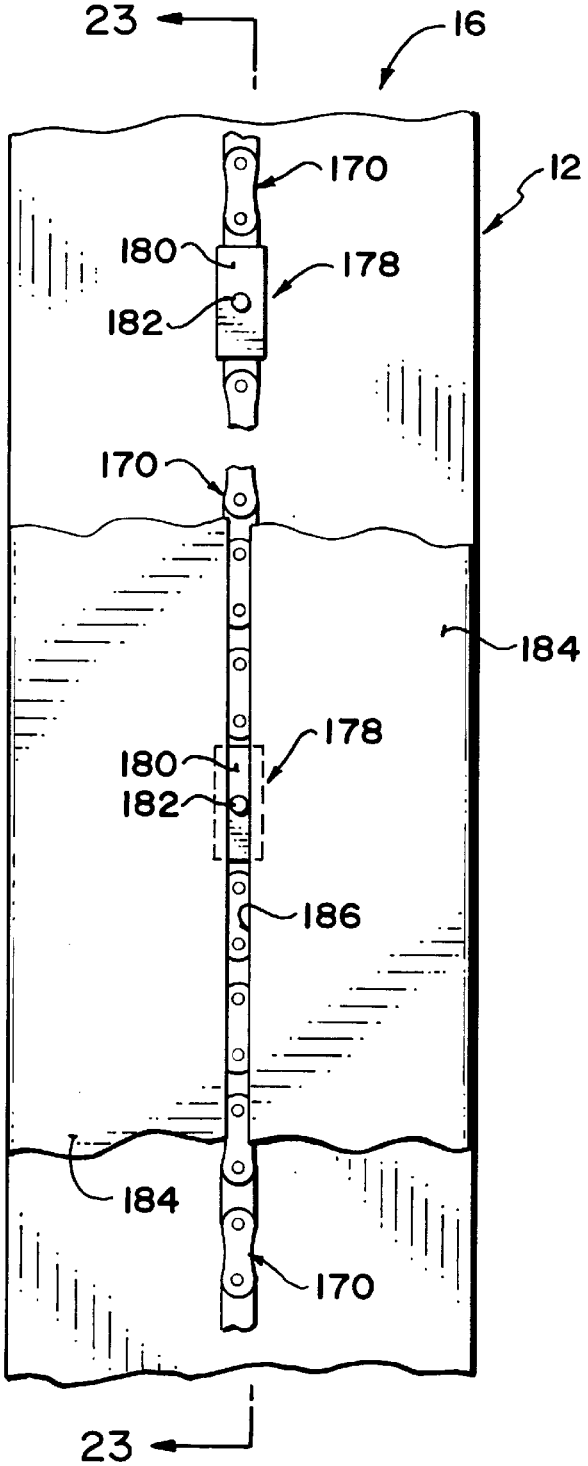
FIG. 22 is a partial front view of the drive means.
Figure 23:
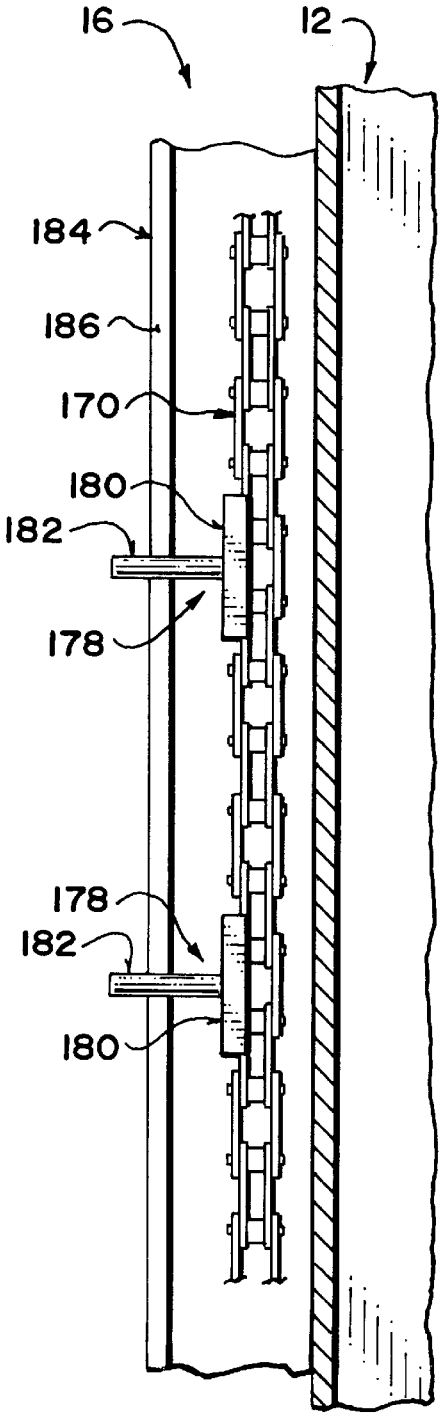
FIG. 23 is a partial side view of the drive means.

Referring to FIGS. 21 and 22 the drive means 16 comprise a sprocket driven chain 170 arranged on each of the support frame ends 24 and 26. The drive means 16 are connected to each of the carrier frames 14 and provide for movement of the carrier frames 14 on the support frame 12. The drive means 16 are provided by a chain 170 which is driven and controlled by a number of sprockets arranged along the length of the chain 170. An electric motor 174 drives the chain 170 over the sprockets. Actuating means 176 are provided for controlling the movement of the chain 170 allowing the operator to selectively reposition the carrier frames 14 into a desired location.

Each carrier frame 14 is connected to the drive chain 170 by an engagement member 178 which comprises a base plate 180 arranged to engage the chain 170 and is fixed to the chain 170. A pin member 182 is fixed to the base plate 180 and is arranged to extend from the base plate 180 towards the carrier frame 14. The pin member 182 is arranged to engage through the tubular member 152 of the mounting member 150 and is retained in place by a retaining means. Some examples of suitable retaining means are retaining pins, nuts, and other fasteners.

The drive means 16 also include a cover 184 extending over the chain 170 and having a slot 186 therethrough. The slot 186 is centered over the chain 170 and is of a width to accept the end of the cylindrical member 182 of each connection member 178 therethrough. The cover 184 helps to prevent wire from spools 11 getting into the chain 170 and binding in the drive means 16.

Referring to FIG. 1 a plurality of upright guard members 188 are provided to prevent items from falling off the carrier frames 14. The guard members 188 are fixed to the outside of the carousel 10 and are spaced apart along the length of the carrier frames 14 and are connected to the frame ends 24 and 26 by a pair of cross members 190. Each of the cross members 190 is fixed at each of its ends to a respective one of the first and second frame ends 24 and 26.

In use an individual wishing to recover an item stored on one of the carrier frames 14 on the wire carousel 10 actuates the drive actuating means 176. This causes the drive means 16 to move the carrier frames 14 around the carousel 10 and past the user. As the carrier frames 14 travel around the carousel 10 the spools 11 are brought into clear view as it passes the operator and allows for easy access a spool of wire 11. When the spool of wire 11 desired is positioned within easy reach the operator deactuates the drive means 16 stopping movement of the carousel 10. The desired item may then be retrieved from the carrier frame 14 or additional items may be added to the carousel 10.

Figure 24:
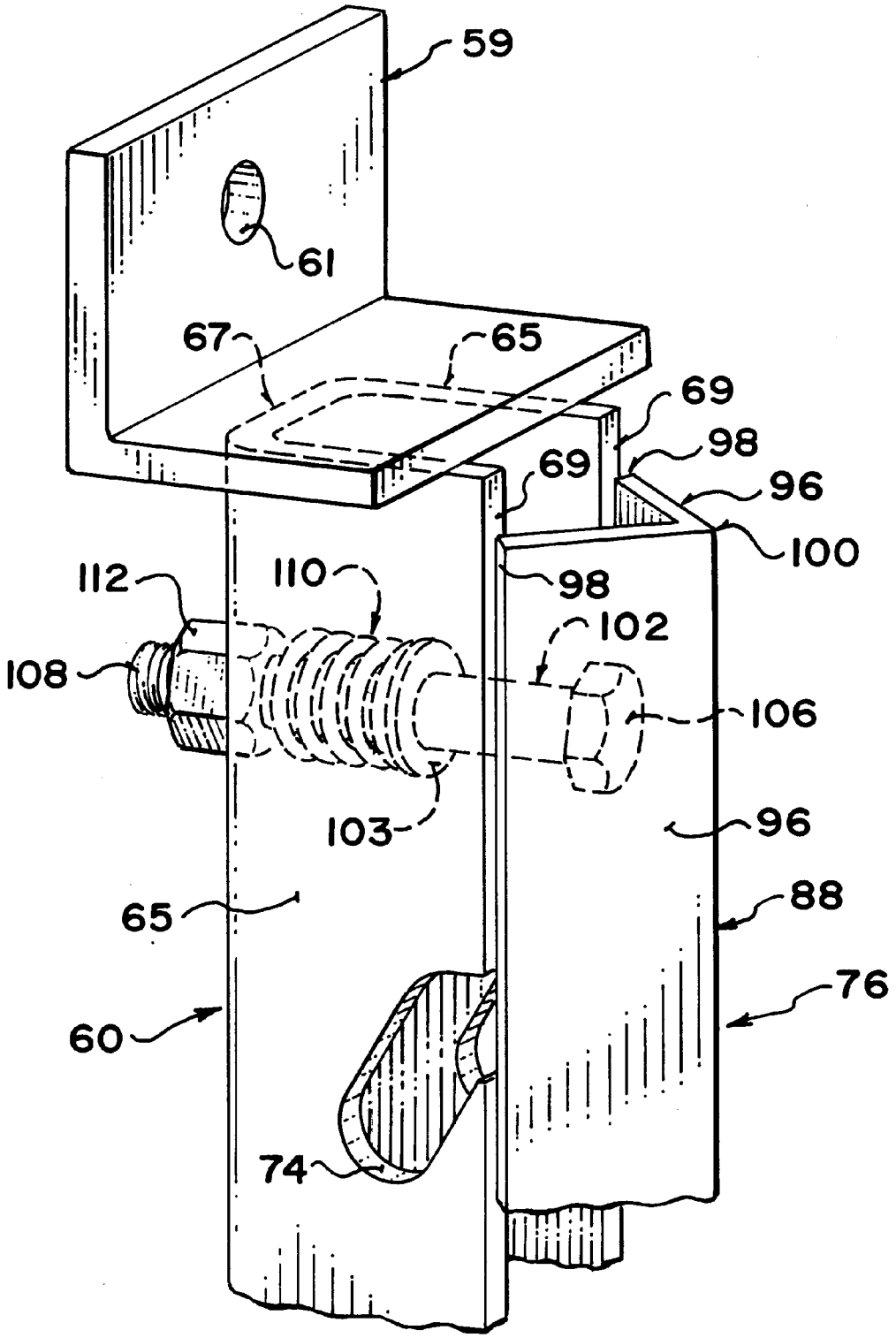
FIG. 24 is a perspective view of an alternative arrangement of the locking mechanism.

Referring to FIG. 24 an alternative arrangement the biasing means 90 is shown arranged such that the coil spring 110 lies between the arms 65 of the U shaped member, adjacent the second end 108 of each elongate member 102, and between the rear side 67 of the U shaped member and the first end of the elongate member 102. The coil spring 110 is arranged around the second end 108 of the elongate member 102 and is fastened in place by a collar 103 fixed to the elongate member 102 and arranged therearound. The collar 103 holds the spring 110 in place around the elongate member 102 between the rear wall 67 of the U-shaped member and the first end 106 of the elongate member 102.

In another alternative arrangement each mounting member 150 includes a pivot connection at the first end 156 thereof. The pivot connection pivotally connects the first end 156 of the mounting member 150 to the carrier frame 14.

Although the embodiment of the wire carousel described above is employed for the storage and retrieval of wire, other embodiments of the present invention may be utilized to store and retrieve any material stored on spools, some examples of which may be cable, chain, rope, and tubing.

While one embodiment of the present invention has been described in the foregoing, it is to be understood that other embodiments are possible within the scope of the invention. The invention is to be considered limited solely by the scope of the appended claims.

I claim:

1. A wire carousel for storing spools of wire said wire carousel comprising:

a support frame having a first upright frame end and a second upright frame end, said second upright frame end being spaced apart from the first upright frame end;

a plurality of carrier frames;

each frame end having mounted thereon an endless loop drive member with the drive members being mounted in parallel planes for supporting the carrier frames therebetween and for supporting the carrier frames in movement upwardly and downwardly relative to the support frame;

each carrier frame comprising a top frame member, a bottom frame member, a first end upright member arranged adjacent the first upright frame end of the support frame, and a second end upright member arranged adjacent the second upright frame end of the support frame, and a plurality of intermediate upright members being spaced apart from one another and extending between the top and bottom frame members and being fixed thereto, the upright members thus being arranged in parallel spaced relation and defining openings between adjacent pairs thereof;

a plurality of shaft members each for carrying at least one spool of wire thereon, each shaft member having respective mount couplings at each end and being arranged to extend between an adjacent pair of the plurality of upright members so as to bridge the opening therebetween and to support said at least one spool in the opening;

each of the upright members having thereon a plurality of longitudinally spaced receptacles, each receptacle forming a slot on the respective upright member arranged to receive a respective one of the mount couplings of a respective one of the shaft members;

the receptacles of each pair of upright members being aligned such that each shaft member can be carried in respective aligned ones of the receptacles of the pair and such that the shaft members can be located at selected positions along the upright members by selecting suitable ones of the receptacles;

each upright member having thereon spring actuated latching means including an abutment closing each slot for holding the mount couplings of the shaft members in the selected receptacles of the upright member during movement of said carrier frames on the drive members, the abutment including a spring urging the abutment into a closed position and the abutment being movable against the spring by pushing of the respective mount coupling against the abutment to open the slot and thus to allow the respective mount coupling to be inserted into the selected receptacle and the latching means being releasable to allow release of the shaft members from the carrier frame for loading of said one or more spools thereon.

2. The wire carousel according to claim 1 wherein the latching means comprises an elongate bar member extending longitudinally of the respective upright member for cooperating with a plurality of the receptacles.

3. The wire carousel according to claim 2 wherein the elongate bar member is supported on the upright member on spring actuated supports for common movement relative to the upright member.

4. The wire carousel according to claim 2 wherein the elongate bar member comprises a single bar extending along the upright member for co-operation with each of the receptacles of the upright member.

5. The wire carousel according to claim 2 wherein at least one of the shaft members carries thereon a rotatable ferris wheel member mounted on the at least one shaft member for rotation around the shaft member, said at least one rotatable ferris wheel including a plurality of rods arranged at angularly spaced positions around the shaft member, each one of said rods being arranged to mount at least one spool of wire thereon.

6. A wire carousel for storing spools of wire said wire carousel comprising:

a support frame having a first upright frame end and a second upright frame end, said second upright frame end being spaced apart from the first upright frame end;

a plurality of carrier frames;

each frame end having mounted thereon an endless loop drive member with the drive members being mounted in parallel planes for supporting the carrier frames therebetween and for supporting the carrier frames in movement upwardly and downwardly relative to the support frame;

each carrier frame comprising a top frame member, a bottom frame member, a first end upright member arranged adjacent the first upright frame end of the support frame, and a second end upright member arranged adjacent the second upright frame and of the support frame, and a plurality of intermediate upright members being spaced apart from one another and extending between the top and bottom frame members and being fixed thereto, the upright members thus being arranged In parallel spaced relation and defining openings between adjacent pairs thereof, the top and bottom frame members and the upright members lying in a common plane of the carrier frame;

a plurality of shaft members each for carrying at least one spool of wire thereon, each shaft member having respective mount couplings at each end and being arranged to extend between an adjacent pair of the plurality of upright members so as to bridge the opening therebetween and to support said at least one spool in the opening;

each of the upright members having thereon a plurality of longitudinally spaced receptacles, each receptacle being arranged to receive a respective one of the mount couplings of a respective one of the shaft members;

the receptacles of each pair of upright members being aligned such that each shaft member can be carried in respective aligned ones of the receptacles of the pair and such that the shaft members can be located at selected positions along the upright members by selecting suitable ones of the receptacles;

each upright member comprising two upright generally parallel plates each at right angles to the plane of the carrier frame and defining an edge of the plate facing away from the plane, each plate having therein a plurality of slots defining said receptacles with each slot having an open mouth at the edge into which the mount couplings of the shaft can be inserted;

each upright member having thereon a spring mounted latching bar for holding the mount couplings of the shaft members in the selected receptacles of the upright member during movement of said carrier frames on the drive members, the latching bar being movable against the spring to allow the respective mount coupling to be inserted by pushing into the selected receptacle and the latching bar being releasable to allow release of the shaft members from the carrier frame for loading of said one or more spools thereon;

the latching bar of each upright member comprising an angle member defining two faces at a right angle with an apex therebetween and edges of the faces spaced from the apex, the bar lying along the plates with the edges of the faces adjacent the edges of the plates so as to co-operate therewith in latching the mount couplings in the receptacles and the apex between the plates and facing any from the plates, the bar being mounted on spring supports such that pressure on one of the faces causes the bar to move such that the apex moves to one side to allow the edge of one of the plates to be exposed to receive the mount coupling of a shaft in a selected one of the receptacles thereof.

7. The wire carousel according to claim 6 wherein the elongate bar member comprises a single bar extending along the upright member for co-operation with each of the receptacles of the upright member.

8. The wire carousel according to claim 6 wherein at least one of the shaft members carries thereon a rotatable ferris wheel member mounted on the at least one shaft member for rotation around the shaft member, said at least one rotatable ferris wheel including a plurality of rods arranged at angularly spaced positions around the shaft member, each one of said rods being arranged to mount at least one spool of wire thereon.

9. A wire carousel for storing spools of wire said wire carousel comprising:

a support frame having a first upright frame end and a second upright frame end, said second upright frame end being spaced apart from the first upright frame end;

a plurality of carrier frames;

each frame end having mounted thereon an endless loop drive member with the drive members being mounted in parallel planes for supporting the carrier frames therebetween and for supporting the carrier frames in movement upwardly and downwardly relative to the support frame;

each carrier frame comprising a top frame member, a bottom frame member, a first end upright member arranged adjacent the first upright frame end of the support frame, and a second end upright member arranged adjacent the second upright frame end of the support frame, and a plurality of intermediate upright members being spaced apart from one another and extending between the top and bottom frame members and being fixed thereto, the upright members thus being arranged in parallel spaced relation and defining openings between adjacent pairs thereof;

a plurality of shaft members each for carrying at least one spool of wire thereon, each shaft member having respective mount couplings at each end and being arranged to extend between an adjacent pair of the plurality of upright members so as to bridge the opening therebetween and to support said at least one spool in the opening;

each of the upright members having thereon a plurality of longitudinally spaced receptacles, each receptacle being arranged to receive a respective one of the mount couplings of a respective one of the shaft members;

the receptacles of each pair of upright members being aligned such that each shaft member can be carried in respective aligned ones of the receptacles of the pair and such that the shaft members can be located at selected positions along the upright members by selecting suitable ones of the receptacles;

at least one of the shaft members carrying thereon a rotatable ferris wheel member mounted on the at least one shaft member for rotation around the shaft member, said at least one rotatable ferris wheel including a plurality of rods arranged at angularly spaced positions around the shaft member, each one of said rods being removable arranged to receive and mount at least one spool of wire thereon.

* * * * *